United States Patent [19]

Polis et al.

[11] Patent Number: 4,463,834

[45] Date of Patent: Aug. 7, 1984

[54] ELEVATOR SYSTEM

[75] Inventors: Marjorie J. Polis, Morristown; Joanne E. Mikhail, Budd Lake, both of N.J.

[73] Assignee: Westinghouse Electric Corp., Pittsburgh, Pa.

[21] Appl. No.: 417,741

[22] Filed: Sep. 13, 1982

[51] Int. Cl.[3] ..... B66B 1/18; B66B 1/20

[52] U.S. Cl. ..... 187/29 R; 340/19 R; 340/20; 340/21

[58] Field of Search ..... 187/29, 29 R; 340/19 R, 340/20, 21

[56] References Cited

U.S. PATENT DOCUMENTS

| | | | |
|---|---|---|---|
| 3,750,850 | 8/1973 | Winkler et al. | 187/29 R |
| 3,804,209 | 4/1974 | Edison | 187/29 R |
| 3,851,734 | 12/1974 | Sackin | 187/29 R |
| 4,037,688 | 7/1977 | Winkler | 187/29 R |
| 4,046,227 | 9/1977 | Kirsh et al. | 187/29 R |
| 4,046,228 | 9/1977 | Powell | 187/29 R |
| 4,047,596 | 9/1977 | Winkler | 187/29 R |
| 4,063,620 | 12/1977 | Mandel et al. | 187/29 R |
| 4,084,661 | 4/1978 | Quan et al. | 187/29 R |
| 4,111,284 | 9/1978 | Winkler et al. | 187/29 R |
| 4,149,613 | 4/1979 | Yoneda et al. | 187/29 R |
| 4,149,614 | 4/1979 | Mandel et al. | 340/19 R X |
| 4,401,190 | 8/1983 | Bittar | 187/29 R |

*Primary Examiner*—G. Z. Rubinson
*Assistant Examiner*—Paul Shik Luen Ip
*Attorney, Agent, or Firm*—D. R. Lackey

[57] ABSTRACT

An elevator system having a plurality of elevator cars and supervisory control for directing their movement in a building to efficiently serve the floors therein. The supervisory control divides the floors and service directions therefrom, called scan slots, into sets, with a set being those scan slots served by the same combination of cars. The scan slots are assigned to the elevator cars using a predetermined strategy, with the sets being taken in a predetermined order determined by the number of cars enabled to serve the sets. The strategy breaks out of the rigid set concept when assigning scan slots to cars based upon car calls, to effect a significant improvement in elevator service.

9 Claims, 7 Drawing Figures

RAM MAP

| CAR 0 | | CAR 1 | | CAR 2 | | CAR 3 | | CAR # 3 2 1 0 | CAR # 3 2 1 0 | CAR # 3 2 1 0 | CAR # 3 2 1 0 | SCAN SLOTS | SET ADDRESSES |
|---|---|---|---|---|---|---|---|---|---|---|---|---|---|
| NSI | NCI | NSI | NCI | NSI | NCI | NSI | NCI | | | | | 16 | 1 1 1 1 |
| | | | | | | | | | | | | 15 | 1 1 1 0 |
| | | | | | | | | | | | | 14 | 1 1 0 1 |
| NSI | NCI | NSI | NCI | NSI | NCI | NSI | NCI | | | | | 13 | 1 1 0 0 |
| NSI | NCI | NSI | NCI | NSI | NCI | NSI | NCI | | | | | 12 | 1 0 1 1 |
| | | | | | | | | DOWN CALL MASKS FRONT DOOR | DOWN CALL MASKS REAR DOOR | UP CALL MASKS FRONT DOOR | UP CALL MASKS REAR DOOR | 11 | 1 0 1 0 |
| | | | | | | | | | | | | 10 | 1 0 0 1 |
| | | | | | | | | | | | | 09 | 1 0 0 0 |
| | | | | | | | | | | | | 08 | 0 1 1 1 |
| | | | | | | | | | | | | 07 | 0 1 1 0 |
| | | | | | | | | | | | | 06 | 0 1 0 1 |
| | | | | | | | | | | | | 05 | 0 1 0 0 |
| | | | | | | | | | | | | 04 | 0 0 1 1 |
| | | | | | | | | | | | | 03 | 0 0 1 0 |
| | | | | | | | | | | | | 02 | 0 0 0 1 |
| | | | | | | | | | | | | 01 | 0 0 0 0 |
| NSI | | NSI | | NSI | | NSI | | | | | | | |
| | NCI | | NCI | | NCI | | NCI | | | | | | |
| 12' | | 13' | | 14' | | 15' | | 9 | 17 | 10 | 18 | | |

FIG. 2

| SCAN SLOTS | FLOOR POSITION | FLOOR FUNCTION | INCORPARATED '688 PATENT: IST PASS – IST SCAN –ASSIGNMENTS– CAR NO. 0 | 1 | 2 | 3 | IMPROVEMENT: –ASSIGNMENTS– CAR NO. 0 | 1 | 2 | 3 | SET NO. | SET PRIORITY |
|---|---|---|---|---|---|---|---|---|---|---|---|---|
| 15 | 16 | TE3 | ▽ | ▨ | CC A↓ | | ▽ | ▨ | CC | | 0 0 0 0<br>1 0 1 1 | |
| 14 | 15 | TE2 | CC A↓ | ▨ | CC A↑ | | CC A↓ | ▨ | CC | | 1 0 1 1<br>1 0 1 1 | 2 |
| 13 | 14 | TE1 | CC A↓ | ▨ | CC A↑ | | CC A↓ | ▨ | CC | | 1 0 1 1<br>1 0 1 1 | |
| 12 | 13 | 11 | CC | | | CC A↑ | CC A↓ | | | CC A↑ | 1 0 1 1<br>1 1 1 1 | |
| 11 | 12 | 10 | | | | △ BP | | | | △ BP | 1 1 1 1<br>1 1 1 1 | |
| 10 | 11 | 9 | | | CC | | | | CC A↑ | | 1 1 1 1<br>1 1 1 1 | |
| 09 | 10 | 8 | | | | | | | | | 1 1 1 1<br>1 1 1 1 | |
| 08 | 9 | 7 | | | | | | | | | 1 1 1 1<br>1 1 1 1 | |
| 07 | 8 | 6 | | | | | | | | | 1 1 1 1<br>1 1 1 1 | 3 |
| 06 | 7 | 5 | | ▽ BP | CC | | | ▽ BP | CC A↑ | | 1 1 1 1<br>1 1 1 1 | |
| 05 | 6 | 4 | | | CC | | | | CC A↑ | | 1 1 1 1<br>1 1 1 1 | |
| 04 | 5 | 3 | | | △ | | | | △ | | 1 1 1 1<br>1 1 1 1 | |
| 03 | 4 | 2 | | | | | | | | | 1 1 1 1<br>1 1 1 1 | |
| 02 | 3 | 1 | CC | CC | | | CC | CC | | | 1 1 1 1<br>1 1 0 0 | |
| 01 | 2 | B1 | | | ▨ | ▨ | | | ▨ | ▨ | 1 1 0 0<br>1 1 0 0 | 1 |
| 00 | 1 | B2 | CC A↑ | | ▨ | ▨ | CC | | ▨ | ▨ | 1 1 0 0<br>0 0 0 0 | UP<br>DN |

CC-CAR CALL
BP-BYPASS
▽-CAR POSITION DOWN TRAVEL
△-CAR POSITION UP TRAVEL
A↑-UP SCAN SLOT ASSIGNED
A↓-DOWN SCAN SLOT ASSIGNED

FIG. 6

ELEVATOR SYSTEM

BACKGROUND OF THE INVENTION

U.S. Pat. Nos. 4,037,688; 4,046,227; 4,046,228; 4,063,620 and 4,111,284, which are all assigned to the same assignee as the present application, disclose a new and improved elevator system in which the strategy utilized by the supervisory control is suitable for implementation by a microprocessor. These patents are hereby incorporated into the present application by reference, and will be hereinafter referred to as the incorporated patents.

The incorporated patents set forth a universal elevator operating strategy which accommodates all possible building configurations in which an elevator car may serve any combination of floors. The car controllers provide complete information to the system processor as to the building configuration which exists at any instant, and thus the supervisory control may be universally applied to any building without any significant modification of the control.

The universal operating strategy periodically assigns the up and down service directions, also called up and down scan slots, respectively, of the floors to the cars by dividing them among all in-service elevator cars within the constraints of predetermined dynamic averages, which distributes the work load evenly among all of the elevator cars. Thus, the car assigned to a specific service direction from a floor will immediately "see" a hall call registered therefrom without any intercession required on the part of the supervisory control system.

Before each new assignment process, the supervisory system control clears all previously assigned scan slots or landing service directions which do not have a registered hall call associated therewith. The supervisory system control then assigns the unassigned scan slots in a plurality of assignment passes, such as three. During the initial assignment pass, each scan slot is examined to see if a car has a car call for the floor associated therewith. If so, a car set for up travel is assigned the up scan slot for this floor if it is not already assigned, and it is not a terminal floor for this car. If it is a terminal floor it would be assigned the down scan slot for this floor. If the car is set for down travel it would be assigned the down scan slot for this floor if it is not already assigned, and it is not a terminal floor for this car. If it is a terminal floor it would be assigned the up scan slot for this car. On the subsequent assignment passes, the scan slots not already assigned are assigned to the cars. The scan slot assignments are made within the restrictions of certain dynamic calculated averages in order to divide the currently existing work load as evenly as possible among all of the in-service elevator cars.

Incorporated U.S. Pat. No. 4,063,620 adds a limit function in the supervisory control which places a limit on automatic car call related assignments. In one embodiment of the limit function, the car call related scan slot assignments are counted. When a predetermined number N of such car call related assignments are made to a car, such as two, or three, as desired, this car will not be assigned any additional scan slots during this assignment process just because they are related to its car calls.

In another embodiment of the limit function, instead of counting the number of car call related scan slot assignments and cutting off such automatic assignments after a predetermined number N have been made, stops to which the car is committed to make due to car and hall calls are counted. These stops are counted and car call related scan slot assignments are made only if the floor associated with the car call is included in the first N stops, such as three stops. Thus, for example if a car has two hall calls assigned to it and the number N is three, only one car call related scan slot assignment will be made to this car if both hall calls are counted before reaching the second car call.

SUMMARY OF THE INVENTION

Briefly, the present invention improves upon the universal operation strategy of the elevator system disclosed in the incorporated patents. The invention recognizes that the strategy related to the assignment of a car call related scan slot can co-act unfavorably with a basic concept of the scan slot assigning process, resulting in a degradation of service in certain elevator/building configurations.

More specifically, a basic concept in the scan slot assigning process, which is an important part of the work load averaging which contributes to the overall excellence of the elevator system, is the "set" concept. Read-only memories in each car control are set to provide binary signals for the supervisory system control indicating which floors, and service directions therefrom, each elevator car is enabled to serve hall calls from. The supervisory system control utilizes these signals to divide the floors and service directions therefrom, i.e., scan slots, into sets, with each set being served by the same combination of cars. With a four car bank, 16 different sets are possible, i.e., those scan slots served by one car, those served by any combination of two or three cars, those served by all four cars, and those served by no cars. The scan slots which are not served by any car are an invalid set. If all cars are enabled for all floors and all service directions, there would be but one set. Once the sets are defined, they are undisturbed until a car provides a signal which indicates that it is going into or out of service, or until a floor is cut out via TDS (traffic director's station), at which time the sets are redefined.

The supervisory system control includes storage means for storing the binary signals relative to which cars are enabled to serve the floors, and service directions therefrom. The binary signals form a binary word for each floor, and service directions therefrom. The binary words are utilized as the set numbers, and also as the address for storing information relative to these set numbers in addressable storage means.

The predetermined priority structure in assigning scan slots in the incorporated patents is set oriented. The sets are considered in the order of increasing number of cars per set. The assignment of the scan slots to the cars associated with each set is made in a plurality of passes, such as three. The car call related assignments are made in the first pass for each set. The scan slots of the sets associated with the fewest number of cars are often widely separated in terms of the physical positions of their associated floors. Thus, even though the hereinbefore described limiting function is applied to car call related assignments, it is still possible for a car to be assigned a scan slot in the car call related pass which will be served by the car for quite some time, due to distance, car load, or both. If a hall call is entered for this scan slot before the next assignment process, the scan slot will not be cleared, and the floor service direction related to the scan slot which could probably be promptly served by another car, will have to wait until the assigned car reaches the associated floor.

The present invention, recognizing the opportunity for adverse co-action of the strategies, goes outside of the set concept during the assignment of car call related scan slots. In one embodiment of the invention, if there are any car calls in the elevator system, a special car call assignment subroutine is called, which is not set oriented. Thus, this embodiment institutes a special additional pass in the assignment process. In another embodiment, the invention works within the constraints of the three-pass arrangement of the incorporated patents, modifying the program to consider scan slots which do not belong to the set being considered, when the car has a car call registered for this scan slot. This approach is feasible, because the assignment process always starts at the location of the associated elevator car and it proceeds away from the elevator car in its travel direction, taking each floor in turn. The incorporated patents check each scan slot and consider only those in the set currently being processed. The present invention, before discarding a scan slot as not belonging to the set being considered, checks to see if the car has a car call for the scan slot, and if so, it considers the scan slot for assignment to the car, applying the hereinbefore mentioned limiting function. This combination of concepts provides a powerful strategy which operates uniformly, regardless of the number of different sets in the car/-building configuration. Thus, in effect, a first predetermined strategy is used for assigning car call related scan slots, which strategy assigns scan slots without regard to the set to which they belong, and a second predetermined strategy assigns scan slots to the cars which is, at least in part, based upon the set concept.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIG. 2 is a RAM map which sets forth a format for storing certain set related signals;

FIG. 6 is a chart which illustrates exemplary scan slot assignments made with, and without, the teachings of the invention, to illustrate the significant improvement in elevator service when using the teachings of the invention.

DESCRIPTION OF THE PREFERRED EMBODIMENTS

Figure 1:
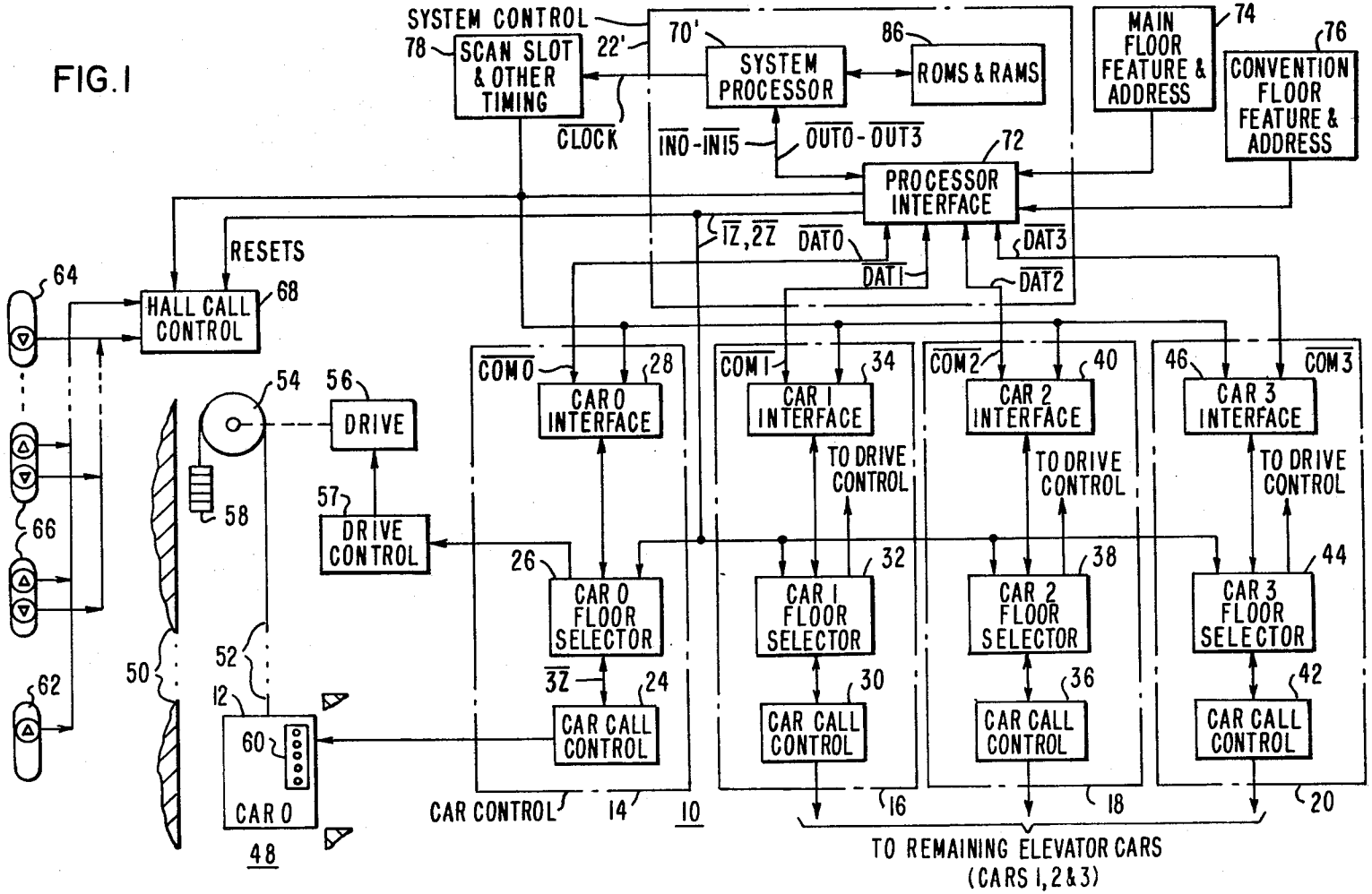
FIG. 1 is a partially schematic and partially block diagram of an elevator system, including supervisory system control, which may utilize the teachings of the invention.

The present application relates to modifications and improvements, both apparatus and method, to the elevator system disclosed in the incorporated patents. Only those portions of the incorporated patents which are necessary to understand and practice the present invention will be described in detail. Apparatus and programming or logic steps of the incorporated applications which are shown in the present application and are unchanged by the present invention are identified with like reference numerals. Reference numerals in the present application which include a prime mark indicate the referenced apparatus or programming step of the incorporated patents has been modified by the present application. New reference numerals are used to indicate apparatus and programming steps which are not shown in the incorporated applications.

Referring now to the drawings, and to FIG. 1 in particular, there is shown an elevator system 10 which may utilize the teachings of the invention. Elevator system 10 includes a bank of elevator cars, with car controls 14, 16, 18 and 20 for four cars being illustrated for purposes of example. Only a single car 12 is illustrated, associated with car control 14, in order to simplify the drawing, since the remaining cars would be similar. Each car control includes a car call control function, a floor selector function, and an interface function for interfacing with supervisory system control 22'. The supervisory system control 22' controls the operating strategy of the elevator system as the elevator cars go about the business of answering hall calls.

More specifically, car control 14 includes car call control 24, a floor selector 26, and an interface circuit 28. Car control 16 includes car call control 30, a floor selector 32, and an interface circuit 34. Car control 18 includes car call control 36, a floor selector 38, and an interface circuit 40. Car control 20 includes car call control 42, a floor selector 44, and an interface circuit 46. Since each of the cars of the bank of cars and their controls are similar in construction and operation, only the controls for car 12 will be described in detail.

Car 12 is mounted in a hatchway 48 for movement relative to a building 50 having a plurality of floors or landings, with only a few landings being illustrated in order to simplify the drawing. The car 12 is supported by ropes 52 which are reeved over a traction sheave 54 mounted on the shaft of a suitable drive motor 56. Drive motor 56 is controlled by drive control 57. A counterweight 58 is connected to the other end of the ropes 52.

Car calls, as registered by pushbutton array 60 mounted in the car 12, are recorded and serialized in the car call control 24, and the resulting serialized car calls $\overline{3Z}$ are directed to the floor selector 26.

Hall calls, as registered by pushbuttons mounted in the halls, such as the up pushbutton 62 located at the bottom landing, the down pushbutton 64 located at the uppermost landing, and the up and down pushbuttons 66 located at the intermediate landings, are recorded and serialized in hall call control 68. The resulting up and down serialized hall calls $\overline{1Z}$ and $\overline{2Z}$, respectively, are directed to the floor selectors of all of the elevator cars, as well as to the supervisory system control 22.

The floor selector 26 keeps track of the car 12 and the calls for service for the car, and provides signals for the drive control 57. The floor selector 26 also provides signals for controlling such auxiliary devices as the door operator and hall lanterns, and it controls the resetting of the car call and hall call controls when a car or hall call has been serviced.

The present invention relates to new and improved group supervisory control for controlling a plurality of elevator cars as they go about the task of answering calls for elevator service, and any suitable floor selector may be used. For purposes of example, it will be assumed that the floor selector disclosed in U.S. Pat. No. 3,750,850 will be used, which patent is assigned to the same assignee as the present application. This patent describes a floor selector for operating a single car, without regard to operation of the car in a bank of cars. U.S. Pat. No. 3,804,209 discloses modifications to the floor selector of U.S. Pat. No. 3,750,850 to adapt it for control by a programmable system processor. In order to avoid duplication and limit the complexity of the present application, these patents, which are assigned to the same assignee as the present application, are hereby incorporated into this application by reference.

The supervisory system control 22' includes a processing function 70' having a memory 86 comprising read-only memories (ROMs) and random access memories (RAMs) and an interface function 72. The processing function 70' receives car status signals $\overline{DAT0}$–$\overline{DAT3}$ from the car controllers, via the interface function 72 which processes all of the inputs and provides a plurality of serialized input signals $\overline{IN0}$–$\overline{IN15}$ for the system processor, as well as the up and down hall calls $\overline{1Z}$ and $\overline{2Z}$, respectively. The system processor 70' prepares assignment words $\overline{OUT0}$–$\overline{OUT3}$ for the elevator cars, which are processed by the interface 72 and applied to the car controllers as assignment words $\overline{COM0}$–$\overline{COM3}$. The assignment words direct the elevator cars to serve the calls for elevator service according to a predetermined strategy. The car status signals $\overline{DAT0}$–$\overline{DAT3}$ provide information for the processing function 70' relative to what each car can do in the way of serving the various floors of the building, and the processing function 70' makes assignments based upon this car supplied information.

Special floor features, shown generally at 74 and 76, may be activated to provide special strategies relative to first and second selectable floors, respectively.

The supervisory system control 22' provides a timing signal $\overline{CLOCK}$ for synchronizing a system timing function 78. The system timing function 78 provides timing signals for controlling the flow of data between the various functions of the elevator system. The elevator system 10 is basically a serial, time multiplexed system, and precise timing must be generated in order to present data in the proper timed relationship. Each floor of the building to be serviced is assigned to its own time or scan slot in each time cycle, and thus the number of time slots in a cycle is dictated by the number of floors in the associated building. Each floor has a different timing scan slot associated therewith, but it is not necessary that every scan slot be assigned to a floor level. Scan slots are generated in cycles of 16, 32, 64 and 128, so a specific cycle is selected such that there will be at least as many scan slots available as there are floor levels. For purposes of example, it will be assumed that there are 16 floors in the building described herein, so the cycle with 16 scan slots will be sufficient.

The 16 scan slot cycle is generated by a binary counter. For example, the binary address of scan slot 00 is 0000, and the binary address of scan slot 01 is 0001, etc.

In general the new and improved group supervisory strategy is universal in character, enabling it to be applied without significant modification to any building. The system processor is completely dependent upon information from the various car controllers as to what each car is capable of doing. The system processor uses this information to set up the specific building configuration which presently exists, i.e., which cars are in service and which floors and service directions therefrom these in-service cars are enabled to serve. The system processor then applies its universal strategy to this configuration.

The universal strategy attempts to evenly distribute, among all in-service cars, the actual work load, as well as the work load which may arise between assignments. The distribution of this actual and possible work load is based upon certain dynamic averages calculated just prior to the making of assignments.

The assignments are primarily "hall button" oriented, rather than "hall call" oriented, at least until the hall calls "assigned" to a car because of the assignment of hall buttons meets one of the applicable dynamic averages. Each hall call button is effectively assigned a scan slot, and these scan slots are assigned to the cars according to the universal strategy. If a floor has front and rear doors, the up and down service directions for each door would all have scan slots associated therewith which are assigned to the cars according to the universal strategy. The elevator system is a serial, time multiplexed arrangement in which the scan slots for the floors are taken in turn.

FIG. 2 is a RAM map which sets forth how down and up call masks may be stored, for both the front and rear doors, if the car has a rear door, which masks are prepared in step 32 of the incorporated patents. The masks show which elevator cars are currently enabled to serve each floor and door at each floor, including the service direction from each door. The masks also show the total number of valid scan slots to be assigned in the assignment process. Registers 9 and 10 are shown in the incorporated patents, and registers 17 and 18 are newly added in order to take care of rear door installations. The per car registers 12, 13, 14 and 15 are modified to include additional registers for each car, with the additional registers being referred to with like reference numerals and a prime mark. The additional registers illustrate how certain set related signals may be temporarily stored adjacent to an appropriate set address. In the example of FIG. 2, there are three valid sets in a four car elevator system serving a building having 16 floors. The three sets are 1011, 1100 and 1111. An example to be hereinafter described relative to FIG. 6 will illustrate how the set numbers are determined. The 16 scan slots 0–15 are each given a different binary count from 0000 through 1111, respectively, with the binary count associated with a valid set number identifying where the associated set related data is stored.

Figure 3:
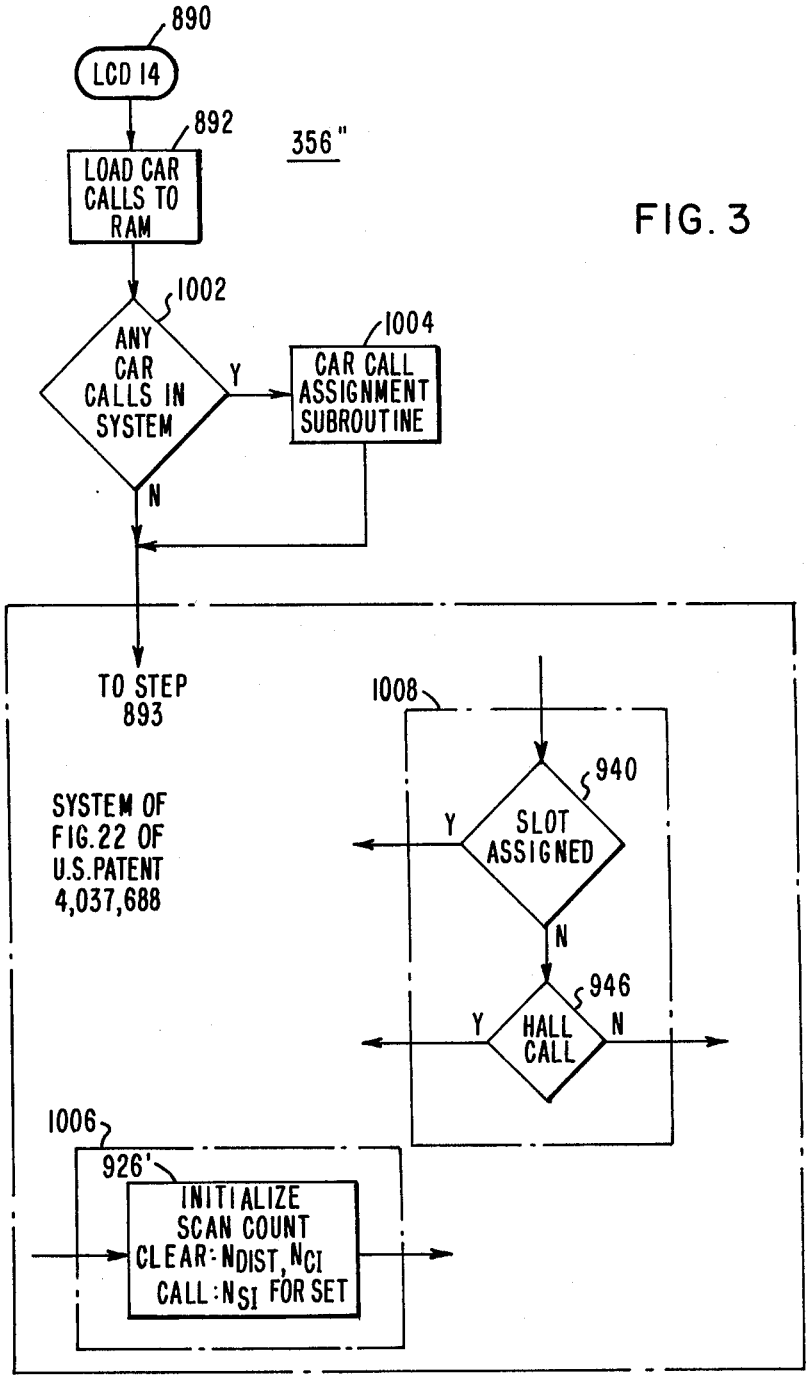
FIG. 3 illustrates a modification of the scan slot assigning program, according to a first embodiment of the invention.

FIG. 3 illustrates a modification of FIG. 22 of incorporated U.S. Pat. No. 4,037,688 ('688). FIG. 22 of this patent sets forth a program LCD 14, whose function is to assign scan slots to the elevator cars. In this embodiment of the invention, a separate assignment pass is initiated, if there are any car calls in the system. Car calls are stored in register 3, as shown in the RAM map of FIG. 5 of the incorporated patent. The program is entered at terminal 890, which starts program LCD 14. Step 892 loads the car calls from RAM 3 to the main memories of the per car registers (RAMs 12–15 in FIG. 5 of incorporated '688 patent. Step 1002 then checks to see if there are any car calls in the elevator system. If there is a registered car call in any elevator car, step 1002 calls a car call subroutine 1004, which is set forth in detail in FIG. 4. Only two other modifications are required to FIG. 22. As shown in broken box 1006, step 926' calls $N_{SI}$ for the car and set being considered. $N_{SI}$ is the number of scan slots assigned to an elevator car so far in the set currently being considered. Since the subroutine 1004 may have already assigned scan slots to certain elevator cars, $N_{SI}$ cannot be cleared when each set is called. As illustrated in FIG. 2, $N_{SI}$ is stored in the additional per car registers, adjacent to the set address it is related to. The final modification to FIG. 22 of the incorporated patent is shown within broken block 1008, which illustrates that the steps 942 and 944 of FIG. 22, related to the car call assignments, are omitted, with the "NO" branch from step 940 proceeding directly to step 946.

Figure 4:
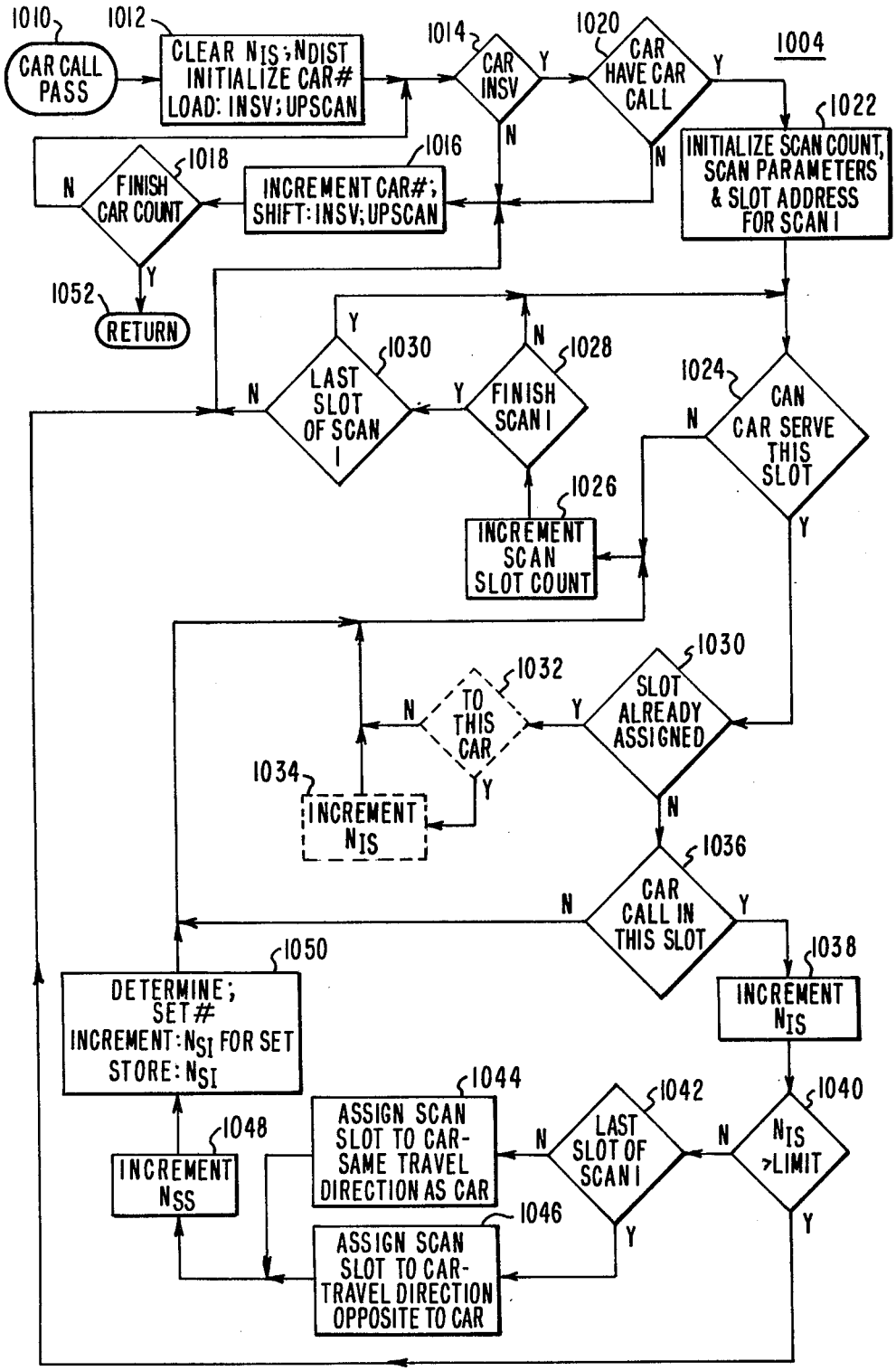
FIG. 4 is a flow chart of a subroutine for assigning car call related scan slots, which is called by the program shown in FIG. 3.
Figure 5A:
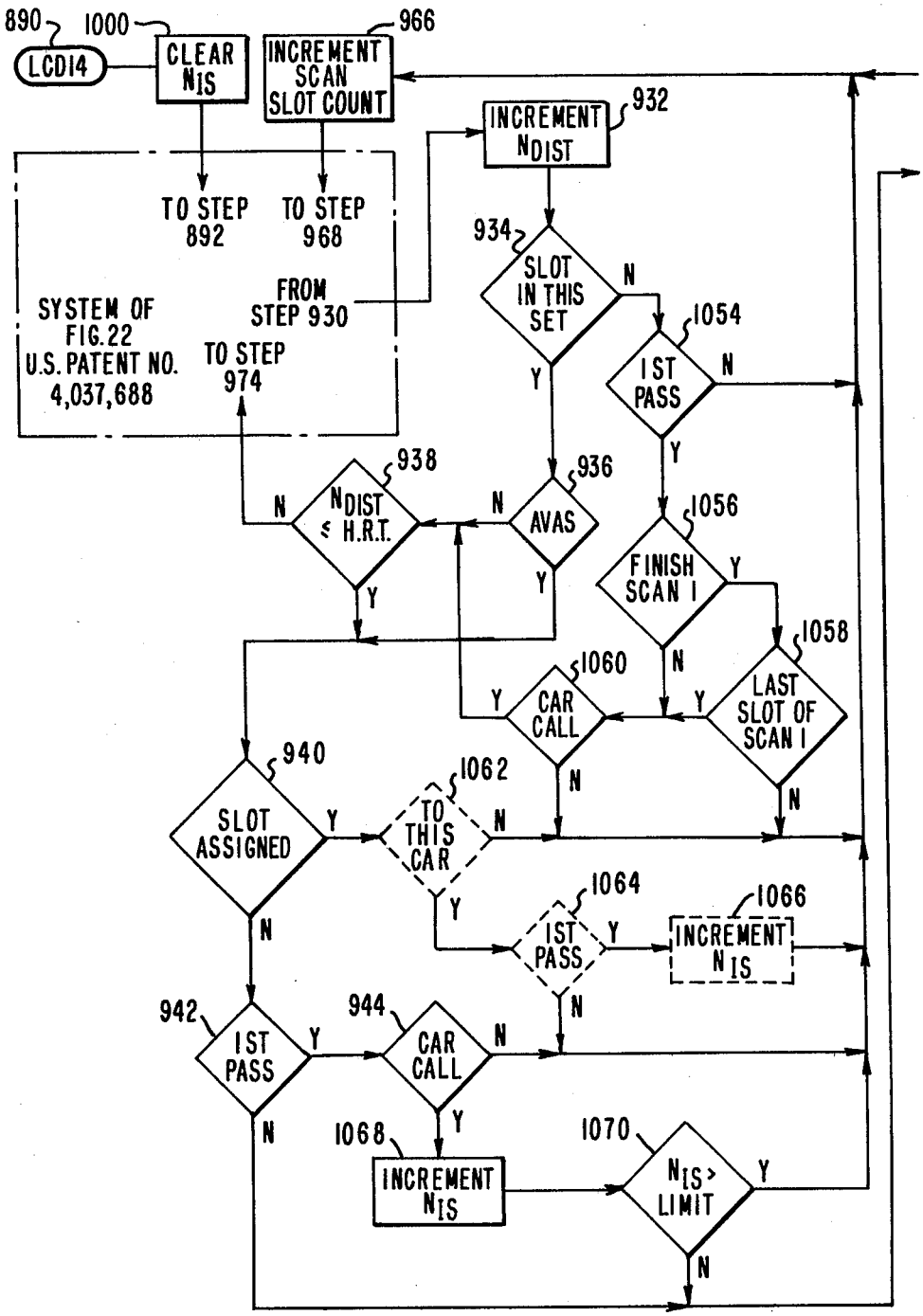
FIGS. 5A and 5B may be assembled to provide a flow chart of a program which assigns car call related scan slots according to another embodiment of the invention.
Figure 5B:
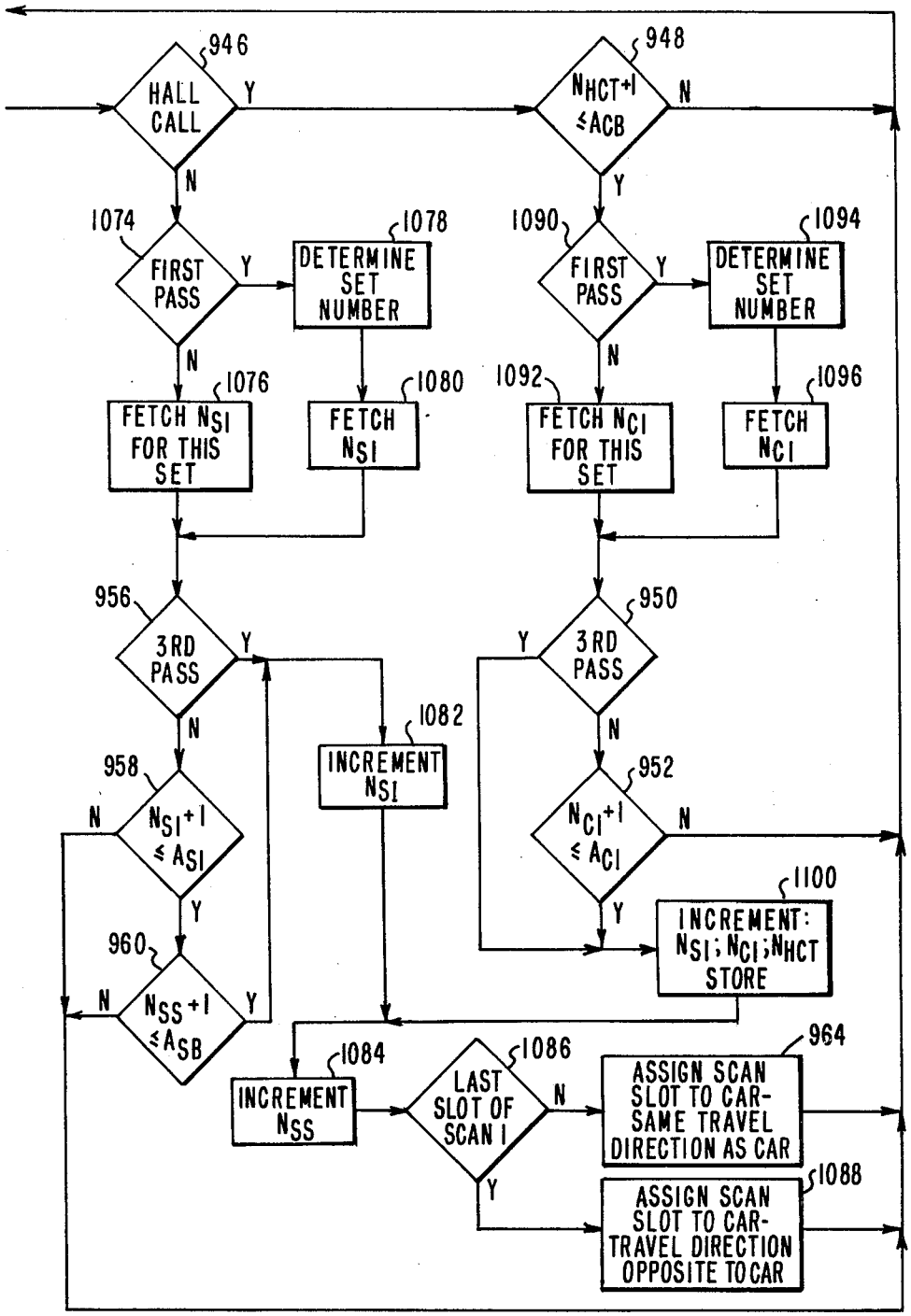

The car call assignment subroutine shown in FIG. 4 is entered at terminal 1010 and step 1012 initializes the subroutine by clearing $N_{IS}$ and $N_{DIST}$, it initializes the car number, and it loads the binary words INSV and UPSCAN. $N_{IS}$ is a software count, which is used in the limit function introduced in incorporated U.S. Pat. No. 4,063,620, to determine when the maximum number of car calls, or the maximum number of stops, has been reached in the car call related assignment of scan slots. $N_{DIST}$ is a variable used to count the valid scan slots as the assignment process starts at the elevator car and proceeds away in a predetermined direction. The car order used in the assignment process is determined by program LCD 8, set forth in FIG. 21 of incorporated patent '688, and is inversely proportional to the existing per-car work load. Thus, initializing the car number starts at the first car number of the ordered car numbers. The word INSV contains a bit for each elevator car, with a logic one indicating the car is in service, and with a logic zero indicating that it is not in service. The word UPSCAN contains a bit for each elevator car, with a logic one indicating the scan slot assignments for the car will start at the car and progress upwardly, and with a logic zero indicating the scan slot assignment will start at the car and proceed downwardly. Program LCD 7 shown in FIG. 20 of the incorporated '688 patent determines the assignment direction. The assignment scan direction is the same as the travel direction for a busy elevator car.

Step 1014 checks the INSV bit for the first car of the ordered car numbers, and if the car is not in-service, the program advances to step 1016 which increments the car count or number, and shifts the words INSV and UPSCAN to present the bits associated with the next car to be considered. Step 1018 checks to see if all cars have been considered. If not, step 1018 returns to step 1014 to see if the car now being considered is in service. If step 1014 finds the car to be in-service, step 1020 checks the appropriate per car register of RAM to see if it has any registered car calls. If not, step 1020 returns to step 1016 to consider the next car in the car order.

If step 1020 finds the car has one or more car calls, step 1022 initializes the scan count, the scan parameters, and slot address for scan 1. The different portions of the scan cycle which examine the scan slots, starting at the car, are given the following scan numbers. Scan 1 starts at the car location and proceeds away therefrom in the direction dictated by the logic level of its UPSCAN bit, until reaching the end of the scan cycle. Scan 2 is the scan which reverses direction at the end of scan 1 and proceeds all the way to the other end of the scan cycle. Scan 3 reverses direction at the end of scan 2 and proceeds back to the scan slot of the elevator car. Since car calls will only be registered for scan 1, it is the only part of the scan cycle which is of interest in this car call assignment pass. The process of determining the scan parameters basically involves determining the number to be subtracted from the floor level of the car position for an up or down traveling car so that the starting slot address may be determined for scan 1. Step 1024 determines if the car is enabled to serve the floor and service direction of the scan slot being considered, by checking the up or down call mask in registers 10 and 9, respectively, of FIG. 5 of the incorporated '688 patent. If it cannot serve this scan slot, step 1026 increments the scan slot count, step 1028 determines if scan 1 has been completed, and if it has, step 1030 determines if the scan slot being considered is the last scan slot of scan 1. If step 1028 finds scan 1 has not been finished, or if step 1030 finds that the last scan slot of scan 1 has been reached, the program returns to step 1024. When all of the scan slots of scan 1, including the last scan slot, have been considered, the program returns to step 1016 to consider the next car.

If step 1024 finds the car enabled for the scan slot being considered, step 1030 checks to see if this scan slot has already been assigned in some previous assignment process. Scan slots for one car sets are pre-assigned in an earlier program, and assigned scan slots having a hall call are not cleared from the car assignment tables, shown in registers 6 and 7 of incorporated patent '688 by step 348 of this incorporated patent. If the slot is already assigned, and the limiting function in the car call assignment process is the number of scan slots assigned to a car due specifically to its car calls, the program returns directly to step 1026 to increment the scan slot count. If the limitation function is related to the number of stops the elevator car will make, instead of to the number of car call related assignments, step 1030 proceeds to step 1032, shown in broken outline, to indicate it is optional. Step 1032 checks to see if the scan slot is assigned to the car being considered. If it is, step 1032 advances to step 1034 which increments counter $N_{IS}$, and step 1034 returns to step 1026. If step 1032 finds the scan slot is not assigned to the car being considered, it advances to step 1026.

If step 1030 finds the scan slot being considered is not assigned, step 1036 determines if this car has a car call registered for this scan slot, If not, the program returns to step 1026. If a car call is registered for this scan slot, step 1038 increments the $N_{IS}$ count, and step 1040 checks to see if $N_{IS}$ now exceeds the predetermined limit. The predetermined limit may be three, for example, i.e., three car call related scan slot assignments, or three stops, as desired. If $N_{IS}$ exceeds the limit, step 1040 returns to step 1016, as this car can accept no further assignments in the car call assignment pass. If step 1040 finds the $N_{IS}$ count does not exceed the limit, step 1042 checks to see if this is the last scan slot of scan 1. If not, step 1044 assigns the scan slot to the car being considered, in the same direction as the car travel direction. If it is the last scan slot of scan 1, step 1046 assigns this scan slot to the car, but in the opposite direction to the car's travel direction. Steps 1044 and 1046 both proceed to step 1048, which increments the count $N_{SS}$ in the appropriate per car register of RAM, which counts the total number of scan slots assigned to the car so far in the assignment process. Step 1050 then determines the set number from the appropriate up or down call masks in registers 9 and 10, respectively, of RAM, and it increments and stores $N_{SI}$ for the appropriate set. $N_{SI}$ is the number of scan slots assigned to a car so far in the appropriate set, and is stored in a per car register, as shown in FIG. 2. Step 1050 returns to step 1026 to increment the scan count. Eventually, all cars will have been considered, and step 1018 will return to the main LCD 14 program from terminal 1052.

The embodiment of FIGS. 3 and 4 involves minimal change in LCD 14, but it does add an additional assignment pass through scan 1. It would be just as effective, and will shorten the program running time, to incorporate the teachings of the invention into the basic framework of the set oriented program LCD 14, making the car call assignments during the first assignment pass. This embodiment of the invention is set forth in FIGS. 5A and 5B, which may be assembled to provide a detailed flow chart of how LCD 14 may be modified according to the teachings of the invention.

More specifically, LCD 14 is entered at terminal 890 and step 1000 clears the $N_{IS}$ count. LCD 14 proceeds as shown in the incorporated '688 patent until completing step 934. If step 934 does not find that the scan slot being considered is in the set being considered, instead of incrementing the scan slot count, as in the incorporated '688 patent, the program temporarily breaks out of the set concept and step 1054 determines if the assignment process is in the first pass of the three passes. If not, the car call related assignment process has already been performed, and the program returns to step 966 to increment the scan slot count. If the assignment process is in the first pass, step 1054 proceeds to step 1056 which checks to see if the first pass is in scan 1. If step 1056 finds scan 1 completed, step 1058 checks to see if the scan slot is the last scan slot of scan 1 (the first scan slot of scan 2). If scan 1 has been finished, and the scan slot is not the last scan slot of scan 1, the program returns to step 966 to increment the scan slot count, as the car call assignment portion of the program has already been completed. If steps 1056 or 1058 find the scan slot being considered is in scan 1, step 1060 checks RAM to see if the car has a car call registered for the scan slot. If not, the program returns to step 966, to increment the scan slot count. If the car has a car call for this scan slot, step 1060 proceeds to step 938.

If step 934 found the scan slot to be in the set under consideration, step 936 would be checked to see if the car is available, according to the floor selector, i.e., not busy. If it is available, an appropriate bit of word AVAS will be a logic one, and the assignments for this car are not limited by the ½ round trip limitation described in the incorporated '688 patent. If the car is busy, step 938 incorporates the ½ round trip limit by comparing $N_{DIST}$, the number of scan slots from the car so far in the assignment routine, with the ½ round trip limit number. If the elevator car is not busy, or busy and the assignment process has not proceeded past the limiting point for a busy car, the program advances to step 940. Step 940 determines if the scan slot has already been assigned. If it has, and only car call related assignments are counted toward the limit $N_{IS}$, step 940 returns to step 966 to increment the scan slot count. If stops are also counted in the $N_{IS}$ number, step 940 proceeds to step 1062 which checks to see if the scan slot is assigned to the car under consideration. If it is, step 1064 determines if the assignment process is in the first pass, i.e., the car call related assignment pass, and if it is, step 1066 increments the $N_{IS}$ count. If step 1062 finds the scan slot is not assigned to the car being considered, or step 1064 finds the assignment process is not in the first pass, or if the process reaches step 1066, each proceeds to step 966 to increment the scan count.

If step 940 finds the scan slot is not assigned, step 942 checks to see if the assignment process is in the first pass. If it is, step 944 checks to see if the car being considered has a car call for the scan slot being considered. If it has, step 1068 increments the $N_{IS}$ count and step 1070 determines if $N_{IS}$ now exceeds the limit. If the assignment process is in the first pass and there is no car call, step 944 returns to step 966 to increment the scan slot count. If there is a car call, and the $N_{IS}$ limit would be exceeded by the assignment, step 1070 returns to step 966. If the $N_{IS}$ limit would not be exceeded, or if step 942 finds the assignment process is not in the first pass, the program advances to step 946.

Step 946 checks to see if there is a hall call registered for the service direction of the scan slot being considered. If there is no hall call, step 1074 checks to see if the assignment process is in the first pass. If it is not, it is known that the scan slot is in this set, and step 1076 fetches the $N_{SI}$ count for the set being considered. $N_{SI}$ tabulates the number of scan slots assigned to the car so far in the associated set.

If step 1074 finds the assignment process is in the first pass, step 1078 determines the set the scan slot is in and step 1080 fetches the $N_{SI}$ count from RAM which is associated with this set number.

Steps 1076 and 1080 both proceed to step 956 which checks to see if the assignment process is in the third pass. If it is not, step 956 proceeds to step 958 which checks to see if the number $N_{SI}$ of scan slots, plus one, assigned to the car so far in the set of the scan slot is equal to or less than $A_{SI}$, the average number of scan slots in a set per in-service car enabled to serve the set. If it is greater than $A_{SI}$, the program returns to step 966 to increment the scan count. If $N_{SI}$, plus one, is not greater than $A_{SI}$, step 960 checks to see if the total number $N_{SS}$ of scan slots, plus one, is equal to or less than $A_{SB}$, the average number of scan slots in the building per in-service car. If $N_{SS}$, plus one, exceeds $A_{SB}$, the program returns to step 966. If $N_{SS}$, plus one, is not greater than $A_{SB}$, step 1082 increments the $N_{SI}$ count for the set of the scan slot, which tabulates the number of scan slots assigned to the car so far in this set. Step 956 advances directly to step 1082 if step 956 found the program in the third assignment pass, since the limitations of steps 958 and 960 are not applied in the third assignment pass. Step 1084 increments $N_{SS}$, the total number of scan slots assigned to the car under consideration, and step 1086 checks to see if the scan slot under consideration is the last scan slot of scan 1. If not, step 964 assigns the scan slot under consideration to the car being considered, using the same travel direction as the travel direction of the elevator car. If step 1086 finds the scan slot to be the last scan slot of scan 1, step 1088 assigns this scan slot to the car, having a travel direction associated therewith which is opposite to the car's present travel direction.

If step 946 finds a hall call registered for the direction of the scan slot under consideration, step 948 checks to see if the total number of hall calls assigned to the car being considered, tabulated as $N_{HCT}$, plus one, is less than or equal to $A_{CB}$, the average number of hall calls in the building per in-service car. If $N_{HCT}$, plus one, exceeds $A_{CB}$, the program returns to step 966, to increment the scan slot count. If $N_{HCT}$, plus one, does not exceed $A_{CB}$, step 1090 checks to see if the assignment process is in the first pass. If it is not, it is known that the scan slot is from the set being considered, and step 1092 fetches $N_{CI}$ for this step. $N_{CI}$ tabulates the number of hall calls assigned to a car in the associated set.

If step 1090 finds that the assignment process is in the first pass, step 1094 determines the set the scan slot is in, and step 1096 fetches $N_{CI}$ for this set.

Steps 1092 and 1096 each proceed to step 950 which checks to see if the assignment process is in the third pass. If it is not, step 950 proceeds to step 952 which determines if $N_{CI}$, plus one, is equal to or less than $A_{CI}$, the average number of calls in the associated set per in-service car. If $N_{CI}$, plus one, exceeds $A_{CI}$, the program returns to step 966. If $N_{CI}$, plus one, does not exceed $A_{CI}$, step 1100 increments $N_{SI}$, the number of scan slots assigned to the car so far, it increments $N_{CI}$, the number of hall calls assigned to the car in the set associated with the scan slot being considered, it increments $N_{HCT}$, the total number of hall calls assigned to the car being considered, and it stores these counts in RAM. Step 1100 proceeds to steps 1084, 1086, 964 or 1088, hereinbefore described. Thus, if the car being considered has a car call for the scan slot being considered, and the scan slot is in the set being considered, the assignment process works as described in the incorporated '688 patent. If the car being considered has a car call for the scan slot being considered, but the scan slot is not in the set being considered, steps 1054, 1056, 1058 and 1060 continue the processing of the scan slot, notwithstanding that it does not belong to the set under consideration.

FIG. 6 illustrates the assignment process for a building having 16 floor levels and four elevator cars, using the strategy of the incorporated '688 patent, and also according to the improved strategy as set forth by the teachings of the present invention. As set forth in FIG. 6, car 0 can serve all floors and possible service directions therefrom. Car 1 cannot serve the three top extension floors TE1, TE2 or TE3, and cars 2 and 3 cannot serve the basement floors B1 and B2. The valid set numbers are thus 1100, 1011 and 1111. using the set related strategy, car 0, located at floor TE3 and having car calls CC for floors TE2, TE1, 11, 1 and B2, would first be assigned scan slot 00 up, noted by the letter A and arrow pointing upwardly, because it is in set 1100, which, having the fewest number of cars, would be taken first. Scan slots 14 down and 13 down in set 1011 would be assigned next, which would then reach the $N_{IS}$ limit of three, for example, and terminate the car call related assignments for this car. If a hall call is registered from floor B2, the assignment of scan slot 00 up would not be cleared on the next running of the program. Thus, car 1, which is loaded and by-passing calls as it expresses to the first floor, would not be assigned scan slot 00 up, even though it will soon be in a position to provide excellent service to a hall call registered from floor B2.

Car 2, located at the third floor with car calls for floors 4, 5, 9, TE1, TE2 and TE3, would be assigned scan slots 13 up, 14 up and 15 down, because set 1011 would be taken before set 1111. Car 3, which is located at floor 10 and by-passing calls due to a load for floor 11, would not be assigned scan slots 13 or 14, should an up hall call be registered from either, since these scan slots would not be cleared on the next running of the program, due to the registered hall call in the interim.

The same building traffic, using the improved strategy of the present invention, would assign the down scan slots 14, 13 and 2 to car 0. Thus, a hall call registered from basement floor B2 would be promptly serviced by car 1. Car 2 would be assigned up scan slots 05, 06, and 10. Thus, up hall calls registered from floors TE1 and TE2 would be quickly serviced by car 3, after it discharges its load at the 11th floor.

We claim as our invention:

1. An elevator system for a building having a plurality of landings, comprising:

a plurality of elevator cars, means mounting said plurality of elevator cars for movement relative to the landings, car call means associated with each of said elevator cars for registering car calls, up and down hall call registering means for registering calls for elevator service in the up and down travel directions, respectively, from at least certain of the landings, means enabling each of said elevator cars to serve calls for elevator service from predetermined landings such that all of the cars are not enabled for the same landings and service directions therefrom, means responsive to which landings each in-service elevator car is enabled to serve, said means dividing the landings of the structure into sets according to the landings served by the same combination of cars, first assignment means which assigns unassigned service directions ahead of each car associated with floors at which each car will stop due to registered car calls, said first assignment means assigning said service directions in a first priority arrangement which makes assignments without regard to the sets which such assignments may belong, and second assignment means effectively assigning calls for elevator service registered on the hall call registering means to the elevator cars by assigning unassigned service directions from the landings to the cars in a second priority arrangement based at least in part upon the sets of landings, and service directions therefrom, served by the same combination of elevator cars.

2. The elevator system of claim 1 wherein the first priority arrangement is based, at least in part, upon the number of such assignments and the location of the assignments relative to the location of the associated elevator car.

3. The elevator system of claim 1 wherein the first assignment means includes means for starting the first priority arrangement at the location of the associated elevator car, and for making car call related assignments in a direction which proceeds away from the elevator in its current travel direction, considering each landing in its proper turn, without regard to the set which each landing belongs to, until a predetermined criterion is reached.

4. The elevator system of claim 3 wherein the predetermined criterion is a predetermined number of such car call related assignments.

5. The elevator system of claim 3 wherein the predetermined criterion is a predetermined number of stops the elevator car is committed to make, due to such car call related assignments, and also due to hall call related assignments made according to the second priority arrangement.

6. The elevator system of claim 1 wherein the second assignment means includes means for considering the sets in the order of increasing number of elevator cars per set.

7. The elevator system of claim 1 wherein the second assignment means assigns landings, and service directions therefrom, to the elevator cars in a plurality of successive assignment passes, with the first assignment means being a special assignment pass initiated only when there is at least one registered car call in the elevator system.

8. The elevator system of claim 1 wherein the second assignment means assigns landings, and service directions therefrom, to the elevator cars in a plurality of successive assignment passes, with the first assignment means being incorporated into one of said assignment passes.

9. A method of providing elevator service for a building having a plurality of floors and a plurality of elevator cars, including the servicing of hall calls generated at the landings and car calls generated in the elevator cars, comprising the steps of:

grouping the floors served by the same combination of elevator cars into sets, dividing successive like periods of time into a plurality of scan slots, assigning each service direction from each floor to one of said scan slots, assigning unassigned scan slots to each car which are associated with the floor at which the car will stop due to a registered car call, in a first priority arrangement, which makes such assignments without regard to the set the scan slot belongs, and assigning hall calls which may be registered to selected elevator cars by assigning unassigned scan slots to the cars in a second priority arrangement based at least in part upon the set to which the scan slot under consideration belongs.

* * * * *